US007899351B2

(12) United States Patent
Maruyama et al.

(10) Patent No.: US 7,899,351 B2
(45) Date of Patent: Mar. 1, 2011

(54) IMAGE FORMING DEVICE

(75) Inventors: Tsuyoshi Maruyama, Nagoya (JP); Masahito Hamaya, Nagoya (JP); Kazushi Shumiya, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 27 days.

(21) Appl. No.: 12/536,471

(22) Filed: Aug. 5, 2009

(65) Prior Publication Data

US 2010/0034552 A1 Feb. 11, 2010

(30) Foreign Application Priority Data

Aug. 8, 2008 (JP) ..... 2008-205893

(51) Int. Cl.
*G03G 15/00* (2006.01)

(52) U.S. Cl. ..... 399/88; 399/71

(58) Field of Classification Search ..... 399/37, 399/38, 71, 75, 88; 363/21.01, 21.1
See application file for complete search history.

(56) References Cited

U.S. PATENT DOCUMENTS 7,362,591 B2 * 4/2008 Inukai ..... 363/21.01
7,809,293 B2 * 10/2010 Inukai ..... 399/37
2008/0019723 A1 1/2008 Naganawa et al.

FOREIGN PATENT DOCUMENTS

JP 2007-156311 A 6/2007
JP 2008-009294 A 1/2008
JP 2008-058475 A 3/2008

* cited by examiner

*Primary Examiner*—Hoan Tran
(74) *Attorney, Agent, or Firm*—Baker Botts L.L.P.

(57) ABSTRACT

There is provided an image forming device, including: a first electrical load; a second electrical load; a voltage generation circuit that generates a second voltage to be applied to the second electrical load; a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level. The controller executes voltage change suppression control of controlling the second voltage such that change of the second voltage becomes gentler as a difference between the first voltage and the first target level becomes larger.

12 Claims, 9 Drawing Sheets

IMAGE FORMING DEVICE

CROSS-REFERENCE TO RELATED APPLICATION

This application claims priority under 35 U.S.C. §119 from Japanese Patent Application No. 2008-205893, filed on Aug. 8, 2008. The entire subject matter of the application is incorporated herein by reference.

BACKGROUND

1. Technical Field

Aspects of the present invention relate to an image forming device.

2. Related Art

Various types of image firming devices have been proposed. One of such image forming devices is a type having a belt for carrying a sheet-like medium and a cleaning mechanism as disclosed in Japanese Patent Provisional Publication No. 2008-58475A (hereafter, referred to as JP 2008-58475A).

The cleaning mechanism disclosed in JP 2008-58475A included a cleaning roller, a cleaning shaft, a shunt type voltage generation circuit and a controller. The shunt type voltage generation circuit is formed, for example, by a transformer and a shunt circuit to generate two voltages including a first cleaning voltage and a second cleaning voltage. The cleaning roller being applied the first cleaning voltage electrically attracts adherents (e.g., coloring agents or fragments of the sheet-like medium) on the belt. The cleaning shaft being applied the second cleaning voltage electrically attracts the adherents on the cleaning roller. The controller adjusts the current level flowing through the shunt circuit so that the first cleaning voltage approaches a first target level while adjusting an output voltage from the transformer so that the second voltage approaches a second target level.

SUMMARY

In general, in the above described shunt type voltage generation circuit, control of the shunt circuit delays with respect to control of the transformer. Therefore, particularly at the time of activation of the voltage generation circuit, the first cleaning voltage overshoots the first target level while being drawn by the second cleaning voltage. In this case, the accuracy of voltage control deteriorates. Furthermore, if the overshoot voltage of the first cleaning voltage is large, an overcurrent might flow between the cleaning roller and the belt. In this case, the belt may be damaged.

Aspects of the present invention are advantageous in that an image forming device capable of preventing accuracy of voltage control from deteriorating due to delay of control of a shunt circuit is provided.

According to an aspect of the invention, there is provided an image forming device, comprising: a first electrical load; a second electrical load; a voltage generation circuit that generates a second voltage to be applied to the second electrical load; a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level. The controller executes voltage change suppression control of controlling the second voltage such that change of the second voltage becomes gentler as a difference between the first voltage and the first target level becomes larger.

Since change of the second voltage by the second control can be suppressed, it becomes possible to prevent accuracy of voltage control from deteriorating due to delay of the first control (i.e., control of the shunt circuit) with respect to the second control (i.e., control of the voltage generation circuit).

According to another aspect of the invention, there is provided an image forming device, comprising: a first electrical load; a second electrical load; a voltage generation circuit that generates a second voltage to be applied to the second electrical load; a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level. When a difference between the second voltage and the second target level exceeds a reference amount, the controller executes voltage change suppression control where at least one of control of adjusting a controlled amount per a unit time for the second control to become smaller in comparison with a case where the difference between the second voltage and the second target level is smaller than or equal to the reference amount, and control of adjusting an execution time interval for the second control to become longer in comparison with the case where the difference between the second voltage and the second target level is smaller than or equal to the reference amount is executed.

Since change of the second voltage by the second control can be suppressed, it becomes possible to prevent accuracy of voltage control from deteriorating due to delay of the first control with respect to the second control.

According to another aspect of the invention, there is provided an image forming device, comprising: a first electrical load; a second electrical load; a voltage generation circuit that generates a second voltage to be applied to the second electrical load; a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level. The controller executes control where the first control is stopped and a current level flowing through the shunt circuit is kept at a level smaller than the current level defined at a time of execution of the first control while executing the second control, and then the controller releases a stopped state of the first control by a time when the second voltage reaches the second target level.

Since the current level flowing through the shunt circuit can be held at a smaller level in comparison with a time of execution of the first control, it is possible to prevent the first voltage from overshooting the second target level. Consequently, it becomes possible to prevent accuracy of voltage control from deteriorating due to delay of the first control with respect to the second control.

According to another aspect of the invention, there is provided an image forming device, comprising: a first electrical load; a second electrical load; a voltage generation circuit that generates a second voltage to be applied to the second electrical load; a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level. The controller operates to: execute the second control to set, as the second target level, a tentative second target level having an absolute value smaller than an absolute value of a real second target level to be applied to the second electric load, while executing the first control to set, as the first target level, a tentative first target level having an absolute value smaller than an absolute value of the tentative second target level; set the second target level to the real second target level and stop the first control while fixing a current level flowing through the shunt circuit when the second voltage reaches the tentative second target level and the first voltage reaches the tentative first target level; and execute the first control where a real first target level to be applied to the first electric load is set as the first target level when the second voltage reaches the real second target level.

With this configuration, the first voltage is intentionally controlled to cause an overshoot at the tentative first target level having a relatively small absolute level, and thereafter, the first control is stopped while fixing the current level flowing through the shunt circuit. Therefore, first voltage changes to approach the real first target level depending on the second control, but not the first control. Consequently, it becomes possible to prevent accuracy of voltage control from deteriorating due to delay of the first control with respect to the second control.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
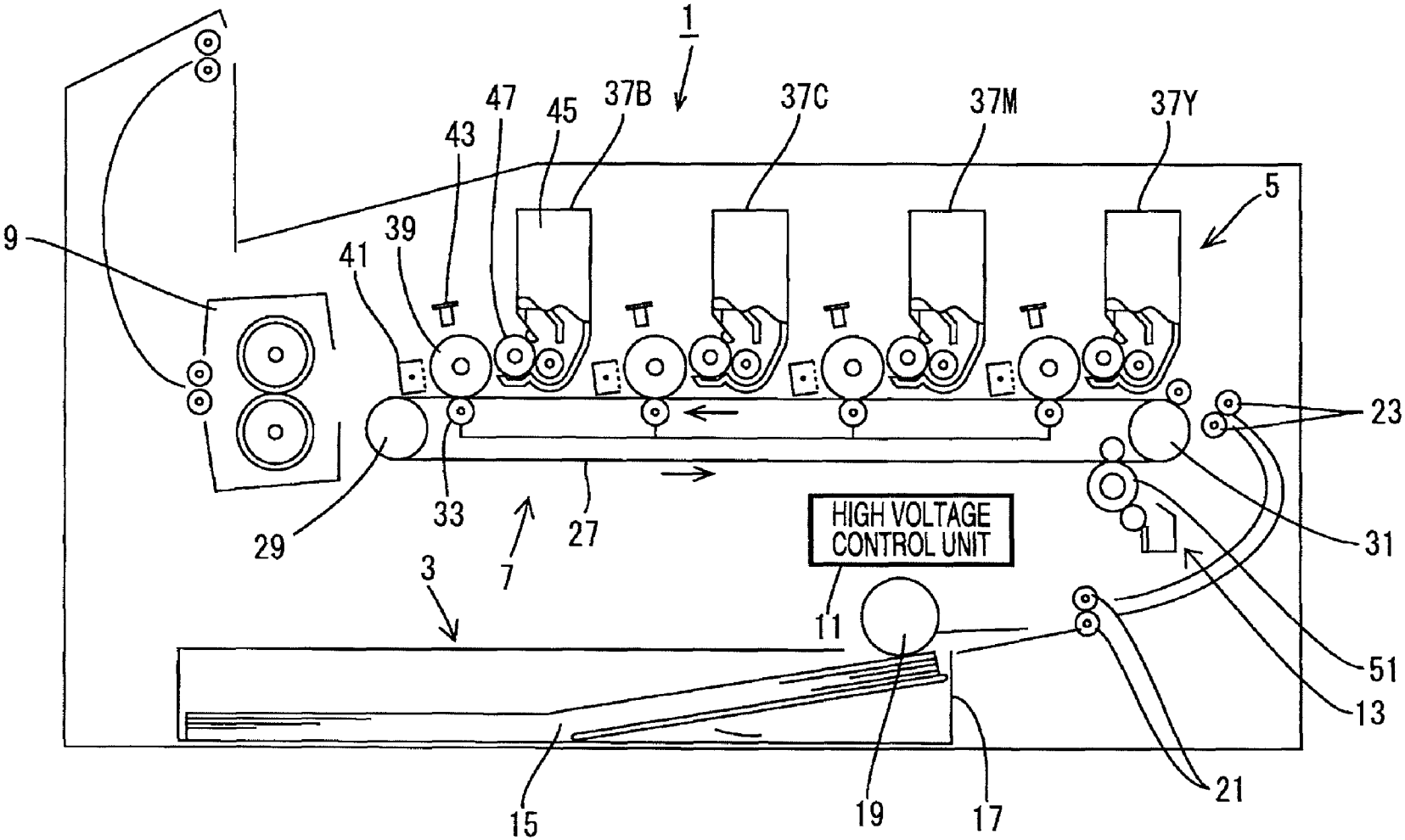
FIG. 1 is a cross sectional view illustrating a general internal configuration of a printer according to a first embodiment.

FIG. 1 is a cross sectional view illustrating a general internal configuration of a printer 1 (an image forming device). In the following, when components are distinguished by color, a subscript symbol "Y" (yellow), "M" (magenta), "C" (cyan) or "B" (black) is assigned to a numerical symbol of each component. On the hand, when components are generally referred, such a subscript symbol is omitted.

The printer 1 includes a paper supply unit 3, an image formation unit 5, a carrying mechanism 7, a fixing unit 9 and a high voltage control unit 11. The printer 1 forms, on a sheet-like medium 15 (e.g., a sheet of paper or an OHP sheet), a toner image formed by single color toner T or multiple colors of toner T (e.g., yellow, magenta, cyan and black color toner). Further, the printer 1 includes a cleaning mechanism 13.

The paper supply unit 3 is located at the bottom of the printer 1, and includes a tray 17 accommodating the sheet-like mediums 15, and a pick-up roller 19. The sheet-like mediums accommodated in the tray 17 are picked up by the pick-up roller 19 one by one to be sent to the carrying mechanism 7 via a registration roller 23.

The carrying mechanism 7 carries the sheet-like medium 15. In the carrying mechanism 7, a belt 27 is hooked to a drive roller 29 and a driven roller 31 to bridge these rollers 29 and 31. When the drive roller 29 rotates, a surface of the belt 27 facing a photosensitive drum 39 moves from the right side to the left side on FIG. 1. By this structure, the sheet-like medium 15 supplied from the registration roller 23 is carried to a position under the image formation unit 5. The carrying mechanism 7 includes four transfer rollers 33.

The image formation unit 5 has four development units 37Y, 37M, 37C and 37B. Each development unit 37 includes a photosensitive body 39, a charger 41, an exposure unit 43 and a unit case 45.

The photosensitive body 39 is formed, for example, by forming a photosensitive layer having a positive electrostatic property on a substrate made of aluminum. The aluminum substrate is grounded to a ground line of the printer 1. The charger 41 serves to positively charge a surface of the photosensitive body 39, for example, to +700V.

The exposure unit 43 has a plurality of light-emitting devices (e.g., LEDs) aligned in a line along a rotation axis of the photosensitive body 39. Each exposure unit 43 controls the plurality of light-emitting devices in accordance with corresponding color data in image data externally inputted to the printer 1 so as to form an electrostatic latent image on the photosensitive body 39.

Each unit case 45 accommodates corresponding color toner T, and has a development roller 47 serving as a development unit. The development roller 47 charges the toner T to "+" (i.e., the development roller 48 charges positively the toner T), and supplies the toner T to the development body 39 as a thin uniform layer. Consequently, the electrostatic latent image is developed as a toner image.

Each transfer roller 33 is located at a position to sandwich the belt 27 between the transfer roller 33 and the photosensitive body 39. Each transfer roller 33 is applied a transfer voltage (e.g., −500 to −7000V) with respect to the photosensitive body 39 by a negative voltage power supply (not shown) so that the toner image formed on the photosensitive body 39 is transferred to the sheet-like medium 15. In this case, the transfer voltage has a reverse polarity with respect to the electrostatic polarity of the toner T. Subsequently, the sheet-like medium 15 is carried to the fixing unit 9 by the carrying mechanism 7, and the toner image is fixed by heat. Then, the sheet-like medium 15 is ejected on the top surface of the printer 1.

Hereafter, a cleaning mechanism of the printer 1 is explained.

Figure 2:
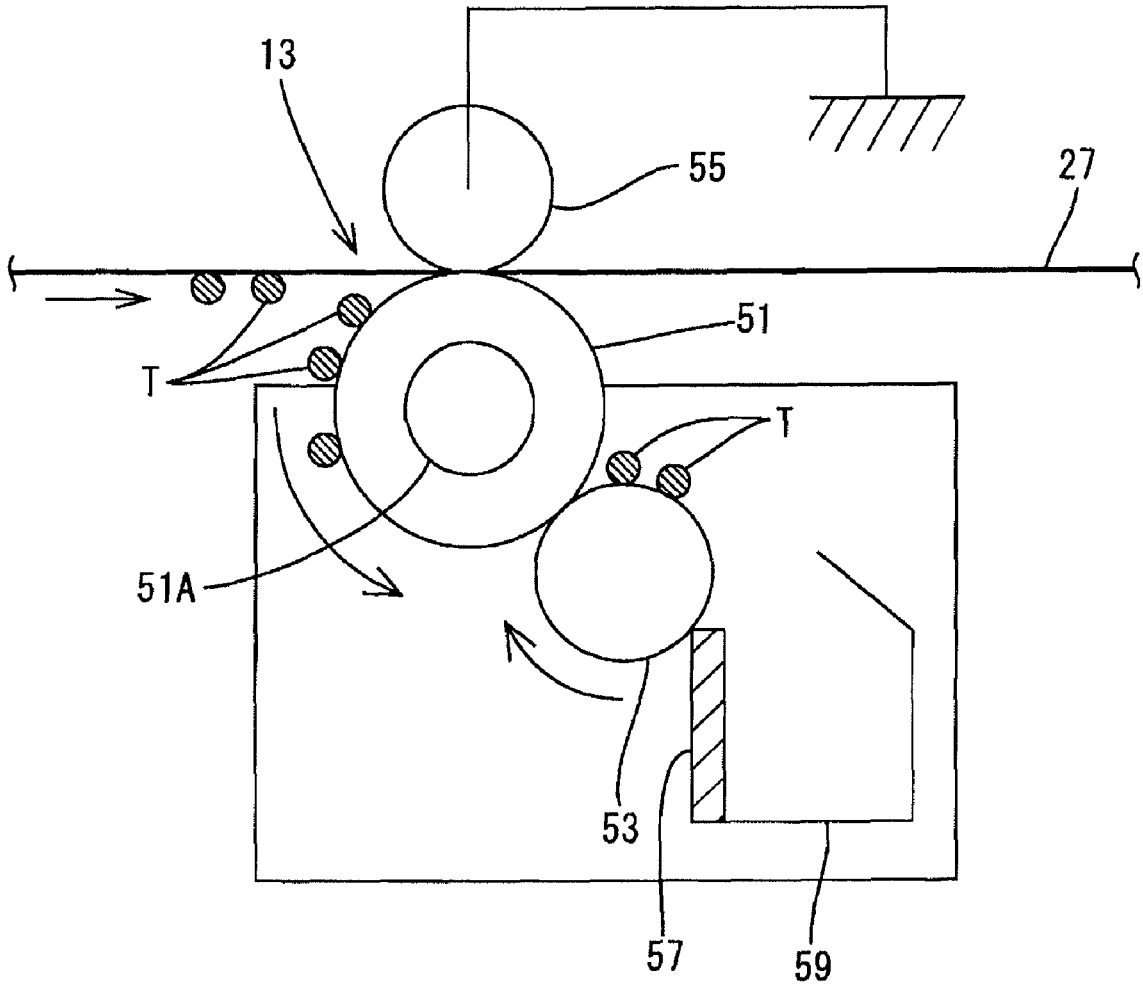
FIG. 2 illustrates a configuration of a cleaning mechanism in the printer shown in FIG. 1.

FIG. 2 illustrates a configuration of the cleaning mechanism 13. The cleaning mechanism 13 which is located under the carrying mechanism 7 serves to clean extraneous matter (e.g., toner T or fragments of paper remaining on the belt 27) adhered to the belt 27. In the following, the toner T is considered as such extraneous matter to be cleaned from the belt 27. The cleaning mechanism 13 includes a cleaning roller 51, a recovery roller 53, a backup roller 55, a cleaning blade 57 and a reservoir box 59.

The cleaning roller 51 is formed by providing expanded material made of silicon to surround an outer surface of an axis member 51A extending in a width direction of the belt 27. The backup roller 55 is configured to have a center shaft made of metal on which rubber material is formed, and is located to face the cleaning roller 51 while sandwiching the belt 27 between the backup roller 55 and the cleaning roller 51. The backup roller 55 is grounded.

The cleaning roller 51 contacts the belt 27. The cleaning roller 51 is driven to move in a direction opposite to the moving direction of the belt 27 at a contact point between the cleaning roller 51 and the belt 27. When a first cleaning voltage V1 applied to the cleaning roller 51 reaches a real first target level VT1 (e.g., −1200V), the cleaning roller 51 becomes able to electrically attracts the toner T adhered to the belt 27, and thereby to clean the surface of the belt 27.

The recovery roller 53 is made of metal, and is located to contact the cleaning roller 51. For example, the recovery roller 53 is configured by plating a metal member with nickel or is made of stainless steel. When a second cleaning voltage V2 (whose absolute value is larger than the absolute value of the first cleaning voltage) applied to the recovery roller 53 reaches a real second target level VT2 (e.g., −1600V), the recovery roller 53 becomes able to electrically attract the toner T adhered to the cleaning roller 51, and thereby to recover the toner T.

The cleaning blade 58 is made of rubber. The cleaning blade 58 is located to contact the recovery roller 53 to scrape the toner T adhered to the recovery roller 53. The scrapped toner T is then stored in the reservoir box 59.

The high voltage control unit 11 generates voltages to be applied to electrical loads including the transfer roller 33, the development roller 47, the charger 41, and the cleaning mechanism 13.

Figure 3:
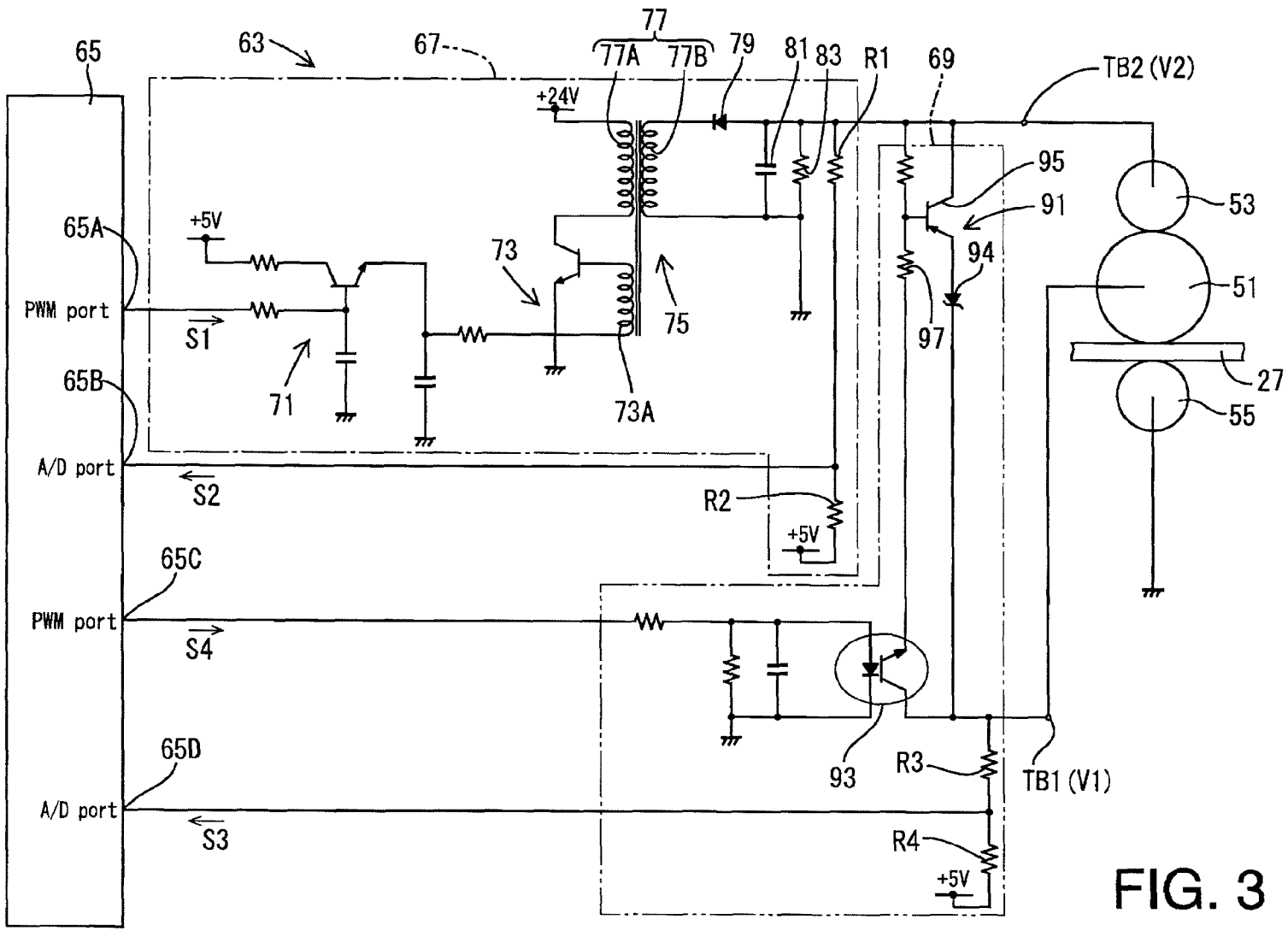
FIG. 3 illustrates a part of a high voltage control unit configured to generate voltages to be applied to the cleaning mechanism.

FIG. 3 illustrates a part of the high voltage control unit 11 configured to generate voltages (i.e., the first and second cleaning voltages V1 and V2) to be applied to the cleaning mechanism 13. The high voltage control unit 11 includes an application circuit 63 and a PWM (Pulse Width Modulation) control circuit 65. The PWM control circuit 65 may be formed of a circuit including a CPU or an ASIC (Application Specific Integrated Circuit).

The application circuit 63 is a two output type shunt circuit configured to output the first and second cleaning voltages V1 and V2. More specifically, the application circuit 63 includes a voltage generation circuit 67 and a shunt circuit 69.

The voltage generation circuit 67 is a power circuit configured to generate the second cleaning voltage V2 to be applied to the recovery roller 53. The voltage generation circuit 67 includes a PWM signal smoothing circuit 71, a transformer drive circuit 73, and a boosting and rectifying circuit 75. The PWM signal smoothing circuit 71 receives a PWM signal S1 from a PWM port 65A of the PWM control circuit 65, smoothes the PWM signal S1, and supplies the PWM signal S1 to the transformer drive circuit 73. The transformer drive circuit 73 has a self-induced winding 73A, and is configured to supply an oscillating current to a primary winding 77A of the boosting and rectifying circuit 75 based on the received PWM signal S1.

The boosting and rectifying circuit 75 includes a transformer 77, a diode 79, and a smoothing capacitor 81. The transformer 77 includes the primary winding 77A and a secondary winding 77B. An end of the secondary winding 77B is connected to a roller shaft of the recovery roller 53 via the diode 79 and a second output terminal TB2. The smoothing capacitor 81 and a discharge resistance 83 are respectively connected to the secondary winding 77B in parallel. In this configuration, the oscillating voltage of the primary winding 77A is boosted and rectified by the boosting and rectifying circuit 75, and is applied to the roller shaft of the recovery roller 53 as the second cleaning voltage V2.

The voltage generation circuit 67 has feedback resistances R1 and R2 for detecting the second cleaning voltage V2. A detection signal S2 corresponding a divided voltage generated by the feedback resistances R1 and R2 is supplied to an A-D port 65B of the PWM control circuit 65. The PWM control circuit 65 performs constant voltage control based on the detection signal S2. More specifically, based on the detection signal S2, the PWM control circuit 65 adjusts a duty ratio of the PWM signal S1 so that the second cleaning voltage V2 is kept at a predetermined target level (i.e., a second target level). Hereafter, such control of the voltage generation circuit 67 for keeping the second cleaning voltage V2 at a second target level (e.g., a real second target level VT2 or a tentative target level) is referred to as "second control". It should be noted that the feedback resistance R2 is connected to a positive voltage line (+5V in this embodiment), but not the ground line. Therefore, it becomes possible to prevent a negative voltage from being supplied to the A-D port 65B.

The shunt circuit 69 generates the first cleaning voltage V1 to be applied to the cleaning roller 51 based on the second cleaning voltage V2. The shunt circuit 69 includes, as main parts, a current control circuit 91 and a photocoupler 93.

The current control circuit 91 includes a transistor 95 serving as a current rectifying device connected between a first output terminal TB1 electrically connected to the cleaning roller 51 and the second output terminal TB2. More specifically, the transistor 95 is a pnp type transistor provided such that a collector is connected to the second output terminal TB2, an emitter is connected to the first output terminal TB1 via a zener diode 94, and a base is connected to the photocoupler 93 via an input resistance 97. Therefore, when the photocoupler 93 is in an OFF state, the transistor 95 is ON. On the other hand, when the photocoupler 93 is an ON state, the transistor 95 is OFF.

Feedback resistances R3 and R4 for detecting the first cleaning voltage V1 are provided on the emitter side of the transistor 95. A detection signal S3 corresponding to a divided voltage generated by the feedback resistances R3 and R4 is supplied to an A-D port 65D of the PWM control circuit 65. It should be noted that the feedback resistance R4 is connected to a positive voltage line (+5V in this embodiment), but not the ground line. Therefore, it becomes possible to prevent a negative voltage from being supplied to the A-D port 65D.

The current control circuit 91 is connected to a PWM port 65C of the PWM control circuit 65 via the photocoupler 93. By adjusting a base voltage of the transistor 95 in accordance with the PWM signal S4 from the PWM port 65C, the current control circuit 91 adjusts a current level, i.e., a resistance value of the transistor 95. The PWM control circuit 65 performs constant voltage control based on the detection signal S3. More specifically, based on the detection signal S3, the PWM control circuit 65 adjusts a duty ratio of the PWM signal S4 so that the first cleaning voltage V1 is kept at a predetermined target level (i.e., the first target level). Hereafter, such control for the shunt circuit 69 for keeping the first cleaning voltage V1 at the first target level (e.g., VT1) is referred to as "first control".

Figure 4:
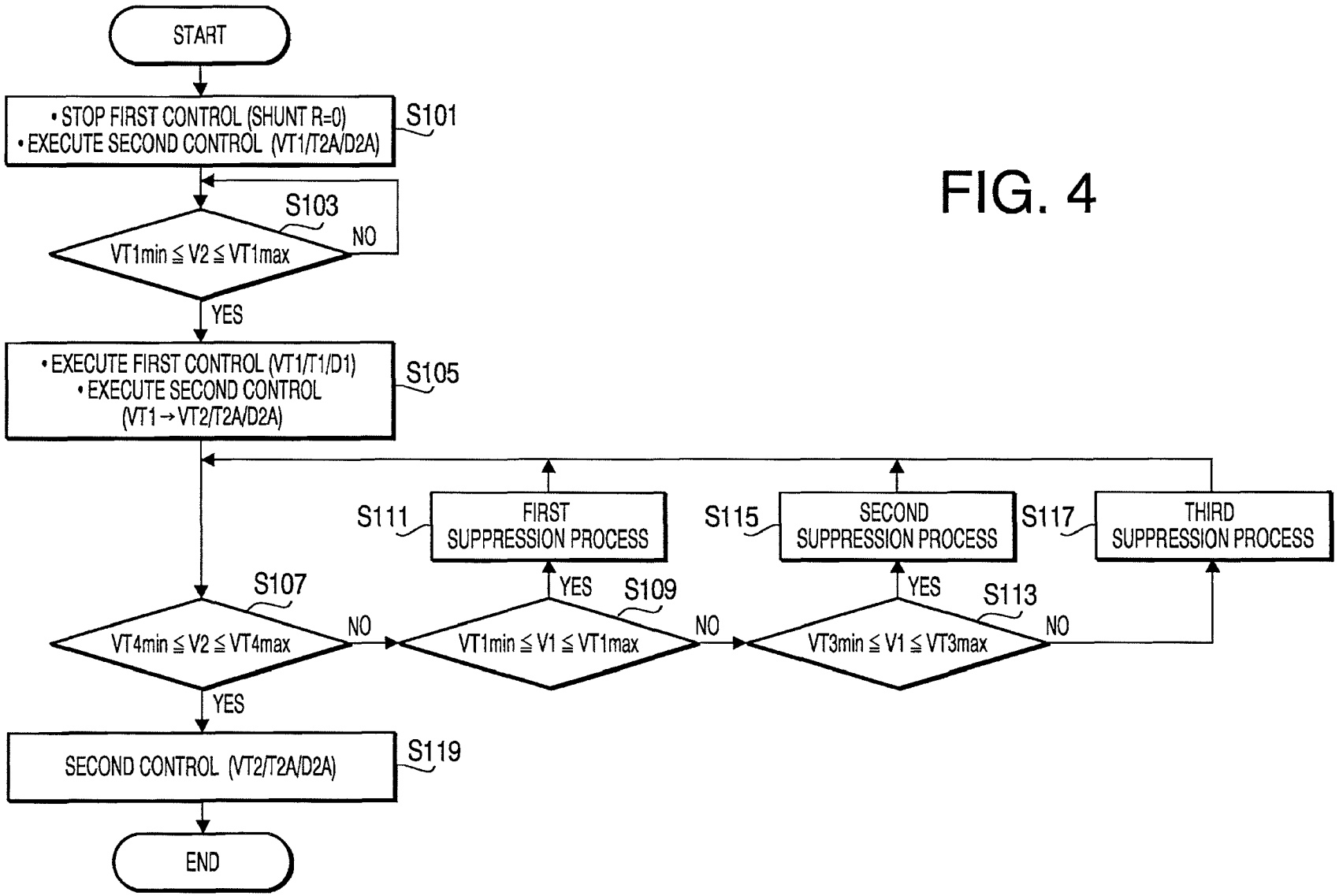
FIG. 4 is a flowchart illustrating a voltage suppression process according to the first embodiment.
Figure 5:
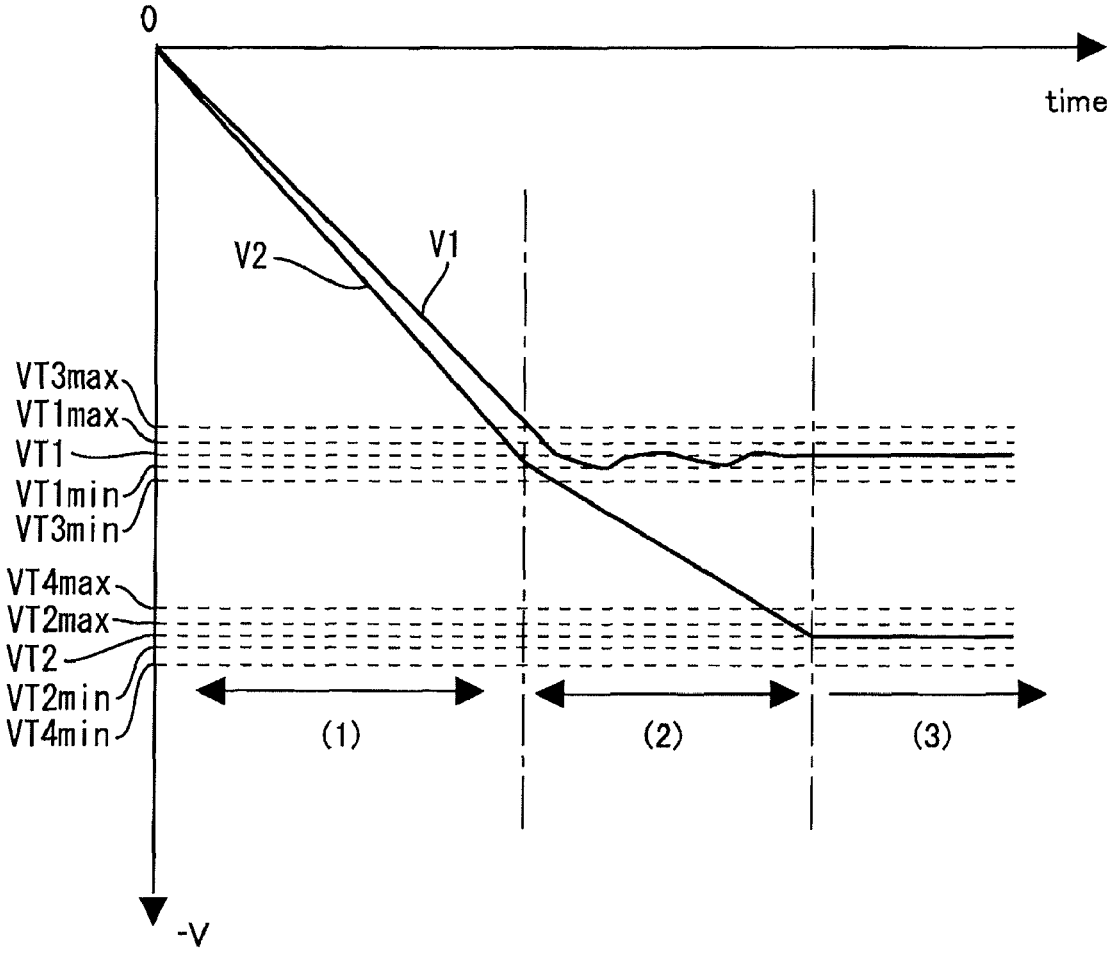
FIG. 5 is a graph illustrating change of each of first and second cleaning voltages with respect to time during the voltage suppression process according to the first embodiment.

FIG. 4 is a flowchart illustrating a voltage suppression process according to the embodiment. FIG. 5 is a graph illustrating change of each of the first and second cleaning voltages V1 and V2 with respect to time during the voltage suppression process.

When the printer 1 is tuned ON, the PWM control circuit 65 activates the voltage generation circuit 67 to perform the voltage suppression process first. By this control, it becomes possible to prevent deterioration of the accuracy of the voltage control due to a delay of the first control (i.e., control for the shunt circuit 69) with respect to the second control (i.e., control for the voltage generation circuit 67). In this case, the PWM control circuit 65 serves as a controller for the voltage suppression process.

Hereafter, a setting up process is explained. In step S101, the PWM control circuit 65 keeps the photocoupler 93 in the OFF state so as not to output the PWM signal S1 while executing the second control. Since the photocoupler 93 is kept in the OFF state, the transistor 95 is ON, and the resistance value (i.e., the shunt resistance) of the transistor 95 is substantially equal to zero. At this moment, the second control is performed such that the second target level is set to a tentative target level whose absolute value is lower than or equal to the absolute value of the real first target level VT1, and an execution time interval is set to a time T2A (e.g., 1 ms) so as to set a change amount of a duty ratio of the PWM signal S1 per a unit time is set to change amount D2A. In this embodiment, the tentative target level is equal to the real first target level VT1.

That is, the PWM control circuit 65 executes, at the interval of the time T2A, a process where the duty ratio of the PWM signal S1 is changed by the change amount D2A to change the second cleaning voltage V2 to the real first target level VT1 based on the level of the detection signal S2. With this configuration, the second cleaning voltage V2 approaches the real first target level VT1 while the first cleaning voltage V1 also follows the change of the second cleaning voltage to approach the real first target level VT1 as shown in the period (1) in FIG. 5.

When the second cleaning voltage V2 enters a first permissible range (the upper limit VT1max, the lower limit VT1min) of the real first target level VT1 (S103: YES), control proceeds to step S105 where the first control is started. In the first control of this state, the first target level is set to the real first target level VT1, and the execution time interval is set to the time T1, and the change amount of the duty ratio of the PWM signal S4 per a unit time is set to the change amount D1. For the second control, the second target level is changed from the real first target level VT1 to the real second target level VT2. With this configuration, as shown in the period (2) in FIG. 5, the real second cleaning voltage VT2 approaches the real second target level VT2, while the first cleaning voltage V1 varies around the real first target level VT1 while being affected by the delay of the first control with respect to the second control.

Hereafter, a voltage change suppression process is explained. In step S1107, the PWM control circuit 65 judges whether the second cleaning voltage V2 is within the second reference range (the upper limit VT4max, the lower limit VT4min). As shown in FIG. 5, the second reference range is wider than the second permissible range (the upper limit VT2mad, the lower limit VT2min) of the real second target level VT2.

At a stage immediately after step S105, the second cleaning voltage V2 is outside the second reference range (S107: NO). Therefore, in this case, the PWN control circuit 65 judges whether the first cleaning voltage V1 is within the first permissible range in step S109. If the first cleaning voltage V1 is within the first permissible range (S109: YES), control proceeds to step S111 where a first suppression process is executed, and control returns to step S107. In the first suppression process, one of an operation where the change amount of the duty ratio of the PWM signal S1 per a unit time is changed to the change amount D2B (the change amount D2B<D2A) and an operation where the execution time interval is set to the time T2B (the time T2B>T2A) is executed in regard to the second control. For example, in this embodiment, the change amount D2B is a half of D2A, and the time T2B is 2 ms. With this configuration, the fluctuation of the second cleaning voltage by the second control becomes small (see the period (2) in FIG. 5) in comparison with the case where the execution time interval stays at the time T2A (i.e., the same as the setting in a normal process after the voltage suppression process). Consequently, it becomes possible to prevent the accuracy of the voltage control from deteriorating due to the delay of the first control with respect to the second control.

If the first cleaning voltage V1 is outside the first permissible range (S109: NO), the PWM control circuit 65 judges whether the first cleaning voltage V1 is within the first reference range (the upper limit VT3max, the lower limit VT3min). As shown in FIG. 5, in step S113, the first reference range is set to have the center value equal to the real first target level VT1. In short, in step S113, the PWM control circuit 65 judges whether the difference between the first cleaning voltage V1 and the real first target level VT1 is lower than or equal to the first reference amount (a half of the first reference range). It should be noted that the first reference range is wider than the first permissible range of the firs target level.

If the first cleaning voltage V1 is within the first reference range (S113: YES), control proceeds to step S115 where a second suppression process is executed, and control returns to step S107. In the second suppression process, one of an operation where the change amount of the duty ratio of the PWM signal S1 per a unit time is changed to the change amount D2C (the change amount D2C<D2B) and an operation where the execution time interval is set to the time T2C (the time T2C>T2B) is executed in regard to the second control. For example, in this embodiment, the change amount D2C is one-third of D2A, and the time T2C is 3 ms. With this configuration, the fluctuation of the second cleaning voltage by the second control becomes small (see the period (2) in FIG. 5) in comparison with the first suppression process. Consequently, it becomes possible to prevent the accuracy of the voltage control from deteriorating due to the delay of the first control with respect to the second control.

On the other hand, if the first cleaning voltage is outside the first reference range (S113: NO), a third suppression process is executed in step S117, and control returns to step S107.

In the third suppression process, one of an operation where the change amount of the duty ratio of the PWM signal S1 per a unit time is changed to the change amount D2D (the change amount D2D<D2C) and an operation where the execution time interval is set to the time T2D (the time T2D>T2C) is executed in regard to the second control. For example, in this embodiment, the change amount D2C is one-third of D2A, and the time T2C is 3 ms. With this configuration, the fluctuation of the second cleaning voltage by the second control becomes small in comparison with the second suppression process. Consequently, it becomes possible to prevent the accuracy of the voltage control from deteriorating due to the delay of the first control with respect to the second control.

Thereafter, when the second cleaning voltages falls within the second reference range (S107: YES), settings for the second control are restored to the initial state before execution of the voltage change suppression process (i.e., the state defined in step S105), and the voltage suppression process shown in FIG. 4 is terminated. In the following process, the first control and the second control are executed under the initial setting condition (i.e., the normal process) to execute the cleaning operation for the belt 27. It should be noted that the voltage suppression process may be executed when a predetermined condition is satisfied (e.g., when the number of sheet-like mediums for which image formation have been finished reaches a predetermined number or when the number of revolutions of the cleaning roller 51 reaches a predetermined number).

Hereafter, advantages achieved by the above described embodiment are explained.

(1) In the above described embodiment, when the difference between the second cleaning voltage V2 and the real second target level VT2 exceeds the second reference amount (S107: NO), at least on of a process for decreasing the change amount of the duty ratio of the PWM signal S1 per a unit time (in comparison with the case where the difference is smaller than or equal to the second reference amount) and a process for increasing the execution time interval (in comparison with the case where the difference is smaller than or equal to the second reference amount) is executed for the second control. With this configuration, it becomes possible to prevent the accuracy of the voltage control from deteriorating due to the delay of the first control with respect to the second control because in this case the change of the second cleaning voltage V2 by the second control becomes smaller in comparison with the time of the initial setting in step S105 or the time of the normal process.

(2) As shown in steps S109 to S117 in FIG. 4, at least one of the process in which the change amount of the duty ratio of the PWM signal S1 per a unit time for the second control becomes larger as the difference between the first cleaning voltage V1 and the real first target level VT1 becomes large and the process in which the execution time interval for the second control becomes larger as the difference between the first cleaning voltage V1 and the real first target level VT1 becomes large is executed for the second control. With this configuration, the fluctuation of the second cleaning voltage by the second control becomes small. Therefore, it becomes possible to prevent the curacy of the voltage control from deteriorating due to the delay of the second control with respect to the first control.

A configuration where the change amount of the duty ratio or the execution time interval may be changed uniformly regardless of the amount of the difference between the first cleaning voltage V1 and the real first target level VT1 might be possible. However, in this case, the time period elapsed before the second cleaning time V2 reaches the real second target level VT2 increases more than necessary. Therefore, it is preferable that, as described in the embodiment, the change amount of the duty ratio per a unit time or the execution time interval is adjusted in response to the difference between the first cleaning voltage V1 and the real first target level VT1.

(3) Since the set-up process is executed before the voltage change suppression process in the voltage suppression process, it becomes possible to prevent the first cleaning voltage V1 from overshooting the real first target level VT1 in comparison with the case where the first control and the second control are executed while setting the first and second target levels respectively to the real target levels VT1 and VT2.

Second Embodiment

Hereafter, a second embodiment is described. Since the feature of the second embodiment corresponds to a variation of the voltage suppression control (i.e., a voltage change suppression process) of the first embodiment, in the following the explanations focus on the feature of the second embodiment. Therefore, in the following, the same reference numbers as those of the first embodiment are also referred to for the explanation of the second embodiment.

Figure 6:
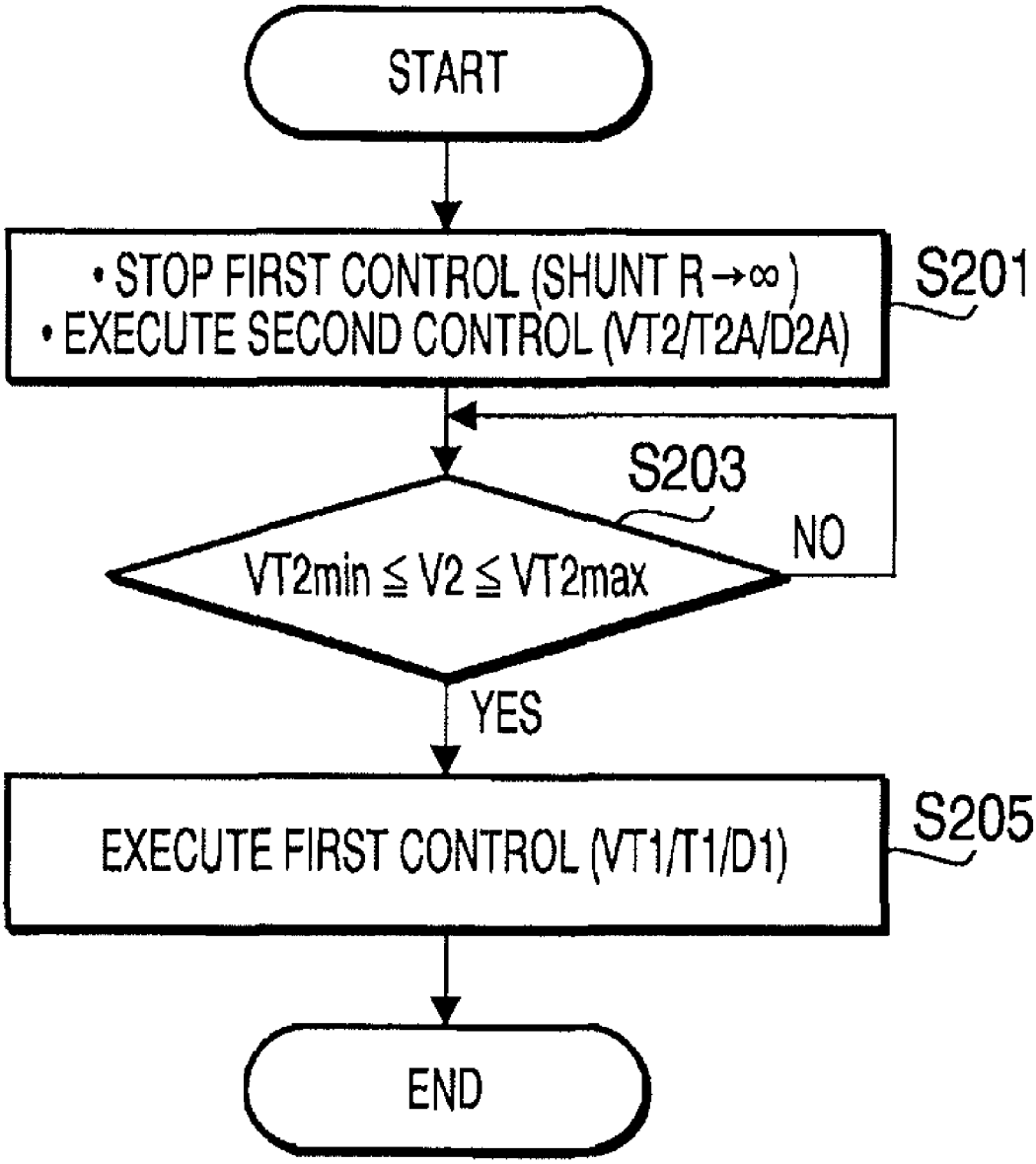
FIG. 6 is a flowchart illustrating a voltage change suppression process according to a second embodiment.
Figure 7:
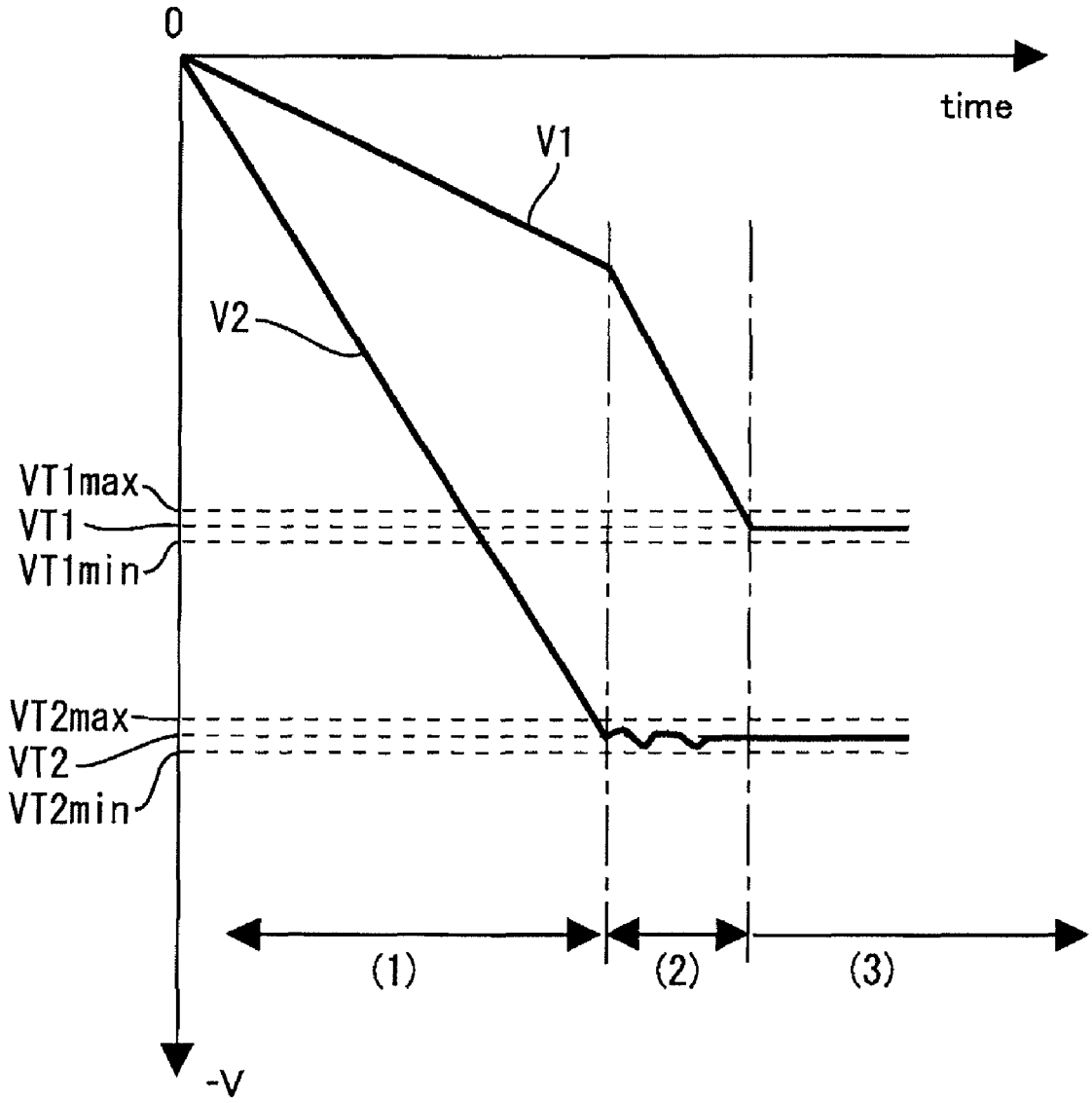
FIG. 7 is a graph illustrating the change of each of the first and second cleaning voltages with respect to time during the voltage change suppression process according to the second embodiment.

FIG. 6 is a flowchart illustrating a voltage change suppression process according to the second embodiment. FIG. 7 is a graph illustrating the change of each of the first and second cleaning voltages V1 and V2 with respect to time during the voltage change suppression process according to the second embodiment. When the printer 1 is turned ON, the PWM control circuit 65 activates the voltage generation circuit 67 to execute the voltage change suppression process.

In step S201, the PWM control circuit 65 stops the first control while outputting a signal for keeping the photocoupler 93 at the completely ON state, and executes the second control (where the second target level is the real second target level VT2, the execution time interval is the time T2A, the change amount of the duty ratio of the PWM signal S1 per a unit time is the change amount D2A). In this case, since the photocoupler 93 is in the ON state, the transistor 95 is OFF to have the resistance value (the shunt resistance value) which has become extremely large in comparison with the normal process after execution of the voltage change suppression process (i.e., execution of the first control). In other words, the current flowing through the shunt circuit 69 (i.e. the transistor 95) has become small.

With this configuration, as shown in a period (1) in FIG. 7, the second cleaning voltage V2 approaches the real second target level VT2. On the other hand, the first cleaning voltage V1 gradually changes because in this case the shunt resistance is large and therefore the drawn amount of the first cleaning voltage by the second cleaning voltage V2 is small.

When the second cleaning voltage falls within the second permissible range of the real second target level VT2 (S203: YES), the PWM control circuit 65 releases the fixed state of the shunt resistance (i.e., the completely ON state of the photocoupler 93), and permits execution of the first control (where the first target level is the real first target level VT1, the execution time interval is the time T1, the change amount of the duty ratio of the PWM signal S4 per a unit time is the change amount D1). With this configuration, as shown in a time period (2) in FIG. 7, the first cleaning voltage V1 approaches the real first target level VT1.

Around the time when the first cleaning voltage V1 reaches the real first target level VT1, the second cleaning voltage V2 has already reached the real second target level VT2, and the fluctuation amount of the second cleaning voltage has V2 has become small. Therefore, it becomes possible to prevent the first cleaning voltage from overshooting the first target level while being drawn by the second cleaning voltage V2. After step S205 is processed, the voltage change suppression process shown in FIG. 6 terminates, and subsequently the first control and the second control are executed to execute the cleaning operation for the belt 27 (see a period (3) in FIG. 7).

Third Embodiment

Hereafter, a third embodiment is described. Since the feature of the third embodiment corresponds to a variation of the voltage suppression control (i.e., a voltage change suppression process) of the first embodiment, in the following the explanations focus on the feature of the third embodiment. Therefore, in the following, the same reference numbers as those of the first embodiment are also referred to for the explanation of the third embodiment.

Figure 8:
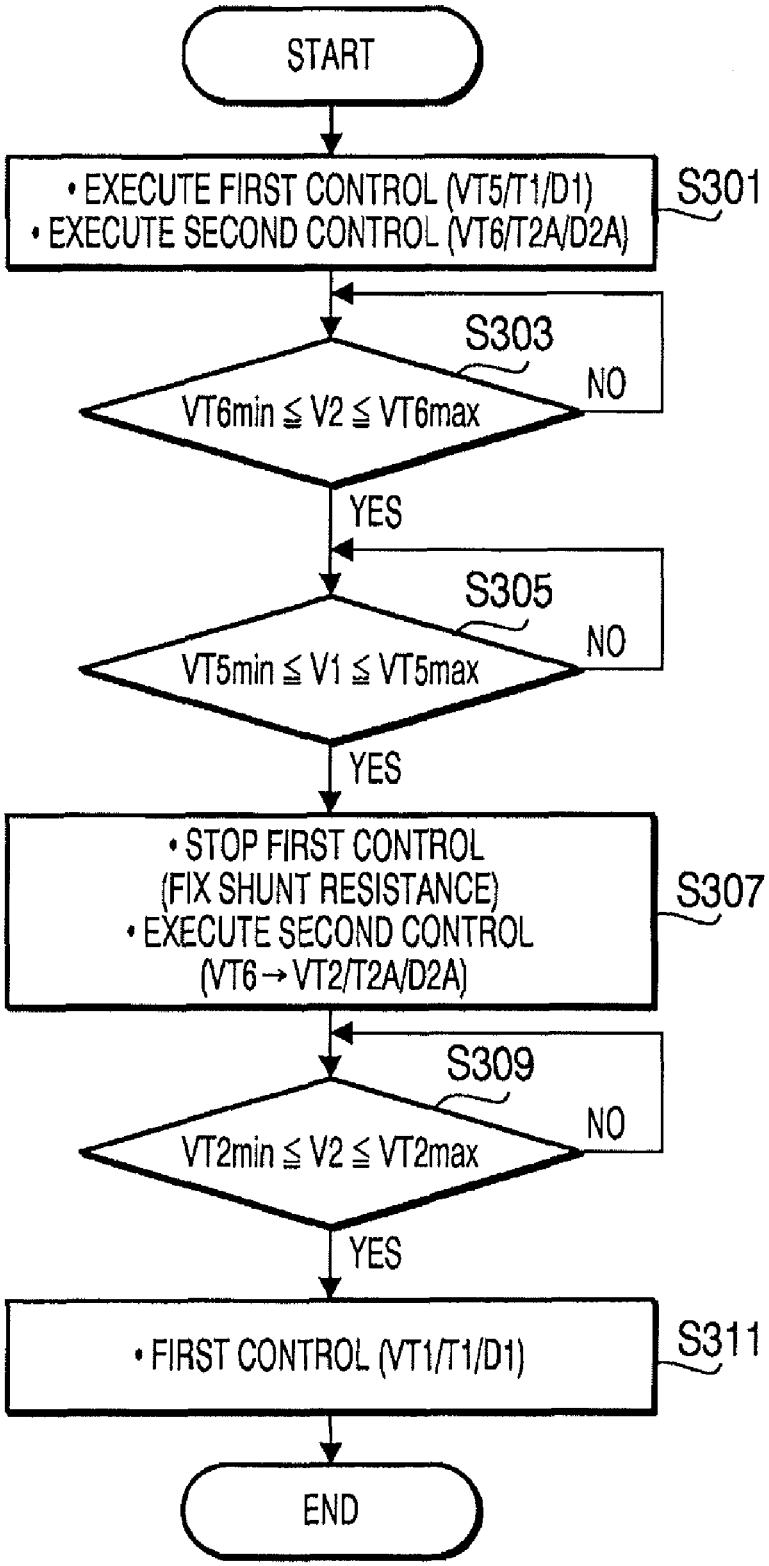
FIG. 8 is a flowchart illustrating a voltage change suppression process according to a third embodiment.
Figure 9:
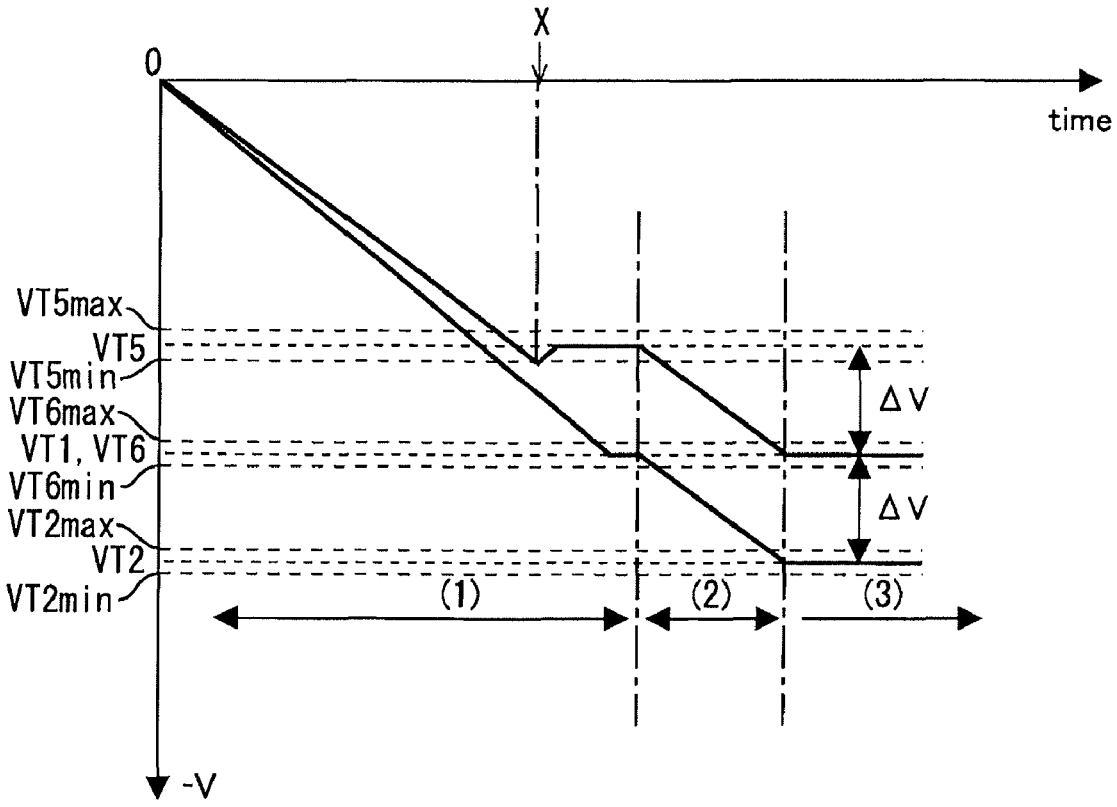
FIG. 9 is a graph illustrating the change of each of the first and second cleaning voltages with respect to time during the voltage change suppression process according to the third embodiment.

FIG. 8 is a flowchart illustrating a voltage change suppression process according to the third embodiment. FIG. 9 is a graph illustrating the change of each of the first and second cleaning voltages V1 and V2 with respect to time during the voltage change suppression process according to the third embodiment. When the printer 1 is turned ON, the PWM control circuit 65 activates the voltage generation circuit 67 to execute the voltage change suppression process.

In step S301, the PWM control circuit 65 executes the first control (where the first target level is a tentative first target level VT5, the execution time interval is the time T1, the change amount of the duty ratio of the PWM signal S4 per a unit time is the change amount D1) and the second control (where the second target level is a tentative second target level VT6, the execution time interval is the time T2A, the change amount of the duty ratio of the PWM signal S4 per a unit time is the change amount D2A).

The absolute value of the tentative second target level VT6 is smaller than the absolute value of the real second target level VT2, and the absolute value of the tentative second target level VT6 is smaller than or equal to the absolute value the real first target level VT1 (e.g., the tentative second target level is −1000V). The absolute value of the first tentative target level VT5 is smaller than the absolute value of the tentative second target level VT6 (e.g., the tentative target level VT5 is −600V). In this embodiment, the difference between the tentative second target level VT6 and the tentative first target level VT5 is set to an amount ΔV (e.g., 400V) substantially equal to the difference between the real first target level VT1 and the real second target level VT2.

In this case, as shown in a period (1) in FIG. 9, the second cleaning voltage V2 approaches the tentative second target level VT6. On the other hand, the first cleaning voltage V1 overshoots the tentative first target level VT5 while being drawn by the second cleaning voltage V2 because of the delay of the first control with respect to the second control (see a period X in FIG. 9). However, as described above, the absolute value of the tentative first target level VT5 is smaller than the real first target level VT1. Therefore, it becomes possible to suppress the current level flowing through the belt 27 and thereby to protect the belt 27.

Thereafter, the PWM control circuit 65 waits until the second cleaning voltage V2 falls within the permissible range of the tentative second target level VT6 (S303: YES), the first cleaning voltage V1 falls within the permissible range of the first tentative target level VT5 (S305: YES) and thereby the normal state is reached. Then, the PWM control circuit 65 stops the first control to fix the shunt resistance while continuing to output the PWM signal S4 whose the duty ratio is fixed at a value defined when the first cleaning voltage V1 is within the tentative first target level VT5. For the second control, the PWM control circuit 65 continues to change the second target level from the tentative second target level VT6 to the real second target level VT2.

In this case, as shown in a period (2) in FIG. 9, the second cleaning voltage V2 approaches the real second target level VT2. On the other hand, the first cleaning voltage V1 varies to move in parallel with respect to the second cleaning voltage V2 while maintaining the voltage difference (i.e., the amount ΔV substantially equal to the difference between the real first target level VT1 and the real second target level VT2) corresponding to the shunt resistance. In this case, the first cleaning voltage V1 is controlled by the second control executed by the voltage generation circuit 67, but not by the first control executed by the shunt circuit 69. Therefore, no effect is caused due to the delay of the first control with respect to the second control. Therefore, as shown in a period (3) in FIG. 9, when the second cleaning voltage V2 falls within the permissible range of the real second target level VT2 (S309: YES), it becomes possible to bring the first cleaning voltage V1 to the real first target level VT1 without causing an overshoot.

Then, the PWM control circuit 65 sets the first target level to the real first target level VT1 for the first control in step S311, and terminates the voltage suppression process. Thereafter, the PWM control circuit 65 continues the first control and the second control (i.e., the normal process) to execute the cleaning operation for he belt 27 (see the period (3) in FIG. 9).

Although the present invention has been described in considerable detail with reference to certain preferred embodiments thereof, other embodiments are possible.

(1) In the above described first embodiment, when the difference between the second cleaning voltage V2 and the real second target level VT2 exceeds the second reference amount (S107: NO), the first suppression process (S111) is executed. However, in this point of view, other embodiments are possible. For example, the first suppression process (S111) may be executed when the difference between the first cleaning voltage V1 and the real first target level VT1 exceeds the first reference amount.

(2) In the above described second embodiment, when the second cleaning voltage V2 reaches the second permissible range of the real second target level VT2, execution of the first control is permitted. However, in this point of view, other embodiments are possible. Execution of the first control may be permitted before the second cleaning voltage V2 reaches the second permissible range and after the second control is executed (S201). For example, the first control may be permitted when the second cleaning voltage V2 reaches the second reference range. In short, control may be executed such that the second cleaning voltage V2 reaches the real second target level VT2 before the first cleaning voltage V1 reaches the first target level.

(3) In the above described third embodiment, the difference between the tentative second target level VT6 and the tentative first target level VT5 is set to the amount ΔV which is substantially equal to the difference between the real first target level VT1 and the real second target level VT2. However, in this point of view, other embodiments are possible. The tentative first target level VT5 may be set such that the absolute value of the tentative first target level VT5 is smaller than the tentative second target level VT6. However, according to the third embodiment, it is possible to change the first cleaning level V1 to the real first target level VT1 smoothly.

(4) In the above described third embodiment, the different target levels are respectively set for the first control and the second control from the initial stage of the voltage change suppression process (see step S301). However, in this point of view, other embodiments are possible. For example, a common target level (e.g., a tentative second target level VT6) may be set for the first control and the second control in the initial stage, and control may proceed to step S301 when the second cleaning voltage V2 reaches the common target level (VT6) (see FIG. 8). With this configuration, it becomes possible to prevent occurrence of an overshoot as shown at the time X in FIG. 9.

(5) In the above described embodiment, the voltage generation circuit 67 is configured to output a high voltage with the transformer 77. However, the voltage generation circuit 67 may have a charge pump circuit. That is, the function of the voltage generation circuit 67 can be achieved with a power circuit.

(6) The above described embodiment focuses on the cleaning mechanism 13 for cleaning the belt 27. However, it is understood that the present invention can also be applied to a cleaning mechanism for removing toner from a photosensitive body (the photosensitive drum 39) after the transferring process. The present invention may be applied to a shunt type application circuit configured to apply a voltage to a charging wire and a grid of the charger 41. In short, the present invention can be applied to various types of shunt type application circuits for applying voltages to two electric loads in a device.

(7) In the above described embodiment, the cleaning mechanism 13 utilizes negative cleaning voltages. However, if the toner has a negative electrostatic property, a positive cleaning voltage may be used.

(8) In the above described embodiment, the printer 1 to which the present invention is applied is a color printer. However, the present invention may also be applied to a printer using single color toner (e.g., a monochrome printer). The printer 1 is configured to have the exposure unit 43 which exposes the photosensitive body 39 by controlling light emission from a plurality of light emission devices. However, the present invention may be applied to a laser printer configured to expose a photosensitive body with laser light. In short, the present invention may be applied to an electrophotographic image forming device.

What is claimed is:

1. An image forming device, comprising:

a first electrical load;

a second electrical load;

a voltage generation circuit that generates a second voltage to be applied to the second electrical load;

a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level, wherein the controller executes voltage change suppression control of controlling the second voltage such that change of the second voltage becomes gentler as a difference between the first voltage and the first target level becomes larger.

2. The image forming device according to claim 1, wherein, in the voltage change suppression process, the controller executes at least one of control of adjusting a controlled amount per a unit time for the second control to become smaller as the difference between the first voltage and the first target level becomes larger, and control of adjusting an execution time interval for the second control to become longer as the difference between the first voltage and the first target level becomes larger.

3. The image forming device according to claim 1, wherein, when a difference between the second voltage and the second target level exceeds a reference amount, the controller executes at least one of control of adjusting a controlled amount per a unit time for the second control to become smaller in comparison with a case where the difference between the second voltage and the second target level is smaller than or equal to the reference amount, and control of adjusting an execution time interval for the second control to become longer in comparison with the case where the difference between the second voltage and the second target level is smaller than or equal to the reference amount.

4. The image forming device according to claim 1, further comprising a cleaning target body, wherein:

the first electrical load includes a first cleaning member used to clean adherents on the cleaning target body;

the second electrical load includes a second cleaning member used to clean adherents on the first cleaning member.

5. An image forming device, comprising:

a first electrical load;

a second electrical load;

a voltage generation circuit that generates a second voltage to be applied to the second electrical load;

a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level, wherein, when a difference between the second voltage and the second target level exceeds a reference amount, the controller executes voltage change suppression control where at least one of control of adjusting a controlled amount per a unit time for the second control to become smaller in comparison with a case where the difference between the second voltage and the second target level is smaller than or equal to the reference amount, and control of adjusting an execution time interval for the second control to become longer in comparison with the case where the difference between the second voltage and the second target level is smaller than or equal to the reference amount is executed.

6. The image forming device according to claim 5, wherein:

the controller executes setting up control where the first control is stopped and the second control is executed while setting the second target level to a tentative target level whose absolute value is smaller than or equal to an absolute value of the first target level; and the controller releases a stopped state of the first control and sets the second target level to a real target level by a time when the second voltage reaches the tentative target level, and thereafter the controller executes the voltage change suppression control.

7. The image forming device according to claim 5, further comprising a cleaning target body, wherein:

the first electrical load includes a first cleaning member used to clean adherents on the cleaning target body;

the second electrical load includes a second cleaning member used to clean adherents on the first cleaning member.

8. An image forming device, comprising:

a first electrical load;

a second electrical load;

a voltage generation circuit that generates a second voltage to be applied to the second electrical load;

a shunt circuit that located between an output side of the voltage generation circuit and the first electrical load; and a controller that executes first control of controlling the shunt circuit to change a first voltage applied from the shunt circuit to the first electrical load to a first target level, and second control of controlling the voltage generation circuit to change the second voltage to a second target level, wherein the controller executes control where the first control is stopped and a current level flowing through the shunt circuit is kept at a level smaller than a current level defined at a time of execution of the first control while executing the second control, and then the controller releases a stopped state of the first control by a time when the second voltage reaches the second target level.

9. The image forming device according to claim 8, further comprising a cleaning target body, wherein:

the first electrical load includes a first cleaning member used to clean adherents on the cleaning target body;

the second electrical load includes a second cleaning member used to clean adherents on the first cleaning member.

10. An image forming device, comprising:

a first electrical load;

a second electrical load;

a voltage generation circuit that generates a second voltage to be applied to the second electrical load;

a shunt circuit that located between an output side of the voltage generation circuit and the first electrical load; and a controller that executes first control of controlling the shunt circuit to chage a first voltage applied from the shunt circuit to the first electrical load to a first target level, and second control of controlling the voltage generation circuit to change the second voltage to a second target level, wherein the controller operates to:

execute the second control to set, as the second target level, a tentative second target level having an absolute value smaller than an absolute value of a real second target level to be applied to the second electric load, while executing the first control to set, as the first target level, a tentative first target level having an absolute value smaller than an absolute value of the tentative second target level;

set the second target level to the real second target level and stop the first control while fixing a current level flowing through the shunt circuit when the second voltage reaches the tentative second target level and the first voltage reaches the tentative first target level; and execute the first control where a real first target level to be applied to the first electric load is set as the first target level when the second voltage reaches the real second target level.

11. The image forming device according to claim 10, wherein a difference between the tentative first target level and the tentative second target level is substantially equal to a difference between the real first target level and the real second target level.

12. The image forming device according to claim 10, further comprising a cleaning target body, wherein:

the first electrical load includes a first cleaning member used to clean adherents on the cleaning target body;

the second electrical load includes a second cleaning member used to clean adherents on the first cleaning member.

* * * * *